US012789969B2

(12) United States Patent
De Carvalho E Silva et al.

(10) Patent No.: US 12,789,969 B2
(45) Date of Patent: Nov. 10, 2026

(54) GAS DISPERSION INTENSIFIER ASSEMBLY FOR PRESSURE RELIEF SYSTEM

(71) Applicant: PETRÓLEO BRASILEIRO S.A.—PETROBRAS, Rio de Janeiro (BR)

(72) Inventors: Daniel Fonseca De Carvalho E Silva, Rio de Janeiro (BR); Jose Guilherme Nascimento Silva, Jr., Rio de Janeiro (BR); Daniel De Oliveira Cota, Rio de Janeiro (BR); Mauro Cresta De Barros Dolinsky, Rio de Janeiro (BR)

(73) Assignee: Petróleo Brasileiro S.A.—Petrobras, Rio de Janeiro (BR)

( * ) Notice: Subject to any disclaimer, the term of this patent is extended or adjusted under 35 U.S.C. 154(b) by 266 days.

(21) Appl. No.: 18/391,013

(22) Filed: Dec. 20, 2023

(65) Prior Publication Data

US 2024/0208632 A1 Jun. 27, 2024

(30) Foreign Application Priority Data

Dec. 25, 2022 (BR) ..... 1020220265879

(51) Int. Cl.
*B63J 2/08* (2006.01)
*B63B 17/00* (2006.01)

(52) U.S. Cl.
CPC ..... *B63J 2/08* (2013.01); *B63B 17/0027* (2013.01)

(58) Field of Classification Search
CPC ..... B63J 2/08; B63B 17/0027
See application file for complete search history.

(56) References Cited

U.S. PATENT DOCUMENTS

2005/0115248 A1* 6/2005 Koehler ..... F17C 1/002 141/82

FOREIGN PATENT DOCUMENTS

| | | | | |
|---|---|---|---|---|
| DE | 202014005325 U1 * | 7/2014 | ..... | B63J 2/08 |
| FR | 2937120 A1 * | 4/2010 | ..... | F23L 17/16 |
| FR | 3109896 A1 | 11/2021 | | |
| GB | 1387678 A | 3/1975 | | |
| KR | 102026052 B1 * | 9/2019 | ..... | B63J 4/00 |
| KR | 20210053091 A * | 5/2021 | ..... | B63J 2/08 |
| KR | 20210108717 A * | 9/2021 | ..... | F17C 9/02 |
| WO | 2015197455 A1 | 12/2015 | | |

* cited by examiner

*Primary Examiner* — William C Doerrler
(74) *Attorney, Agent, or Firm* — Sterne, Kessler, Goldstein & Fox P.L.L.C.

(57) ABSTRACT

The present invention belongs to the field of technologies aimed at production units with difficulties in dispersing gases from pressure relief systems. More specifically, the present invention relates to a gas dispersion intensifier assembly for a pressure relief system, which comprises: at least one blower; and a gas dispersion pipe with a gas outlet nozzle; wherein at least one blower is arranged externally and in the vicinity of the gas outlet nozzle, and projects an air flow toward the gas flow expelled by the gas outlet nozzle.

24 Claims, 10 Drawing Sheets
(10 of 10 Drawing Sheet(s) Filed in Color)

GAS DISPERSION INTENSIFIER ASSEMBLY FOR PRESSURE RELIEF SYSTEM

FIELD OF THE INVENTION

The present invention relates to the field of vessels, platforms, rigs and production facilities, and more specifically, the present invention refers to a gas dispersion intensifier assembly to be applied to a floating production, storage and offloading (FPSO) unit with difficulties in dispersing gases from a pressure relief system ("vent post").

BACKGROUND OF THE INVENTION

In FPSO production units, due to the fact that the transported cargo (hydrocarbons) is highly volatile and flammable, it is necessary to have a protection system against possible overpressure events (pressure above the design pressure of the tanks) inside the cargo tanks. In general, hydrocarbon vapors loaded into an FPSO do not ignite in atmospheres with an oxygen concentration of less than approximately 11%. Thus, a tank is protected from the risk of explosion when its atmosphere is maintained with an oxygen concentration below this value.

In order to keep this oxygen concentration low in the environment, an inert gas (e.g., nitrogen or carbon dioxide) is pumped into the cargo tanks during the discharge of flammable fluids. It is worth noting that, in addition to being responsible for controlling the environment and preventing the formation of flammable substances, inert gas is produced on board the FPSO by burning diesel oil or fuel gas in an inert gas generator.

Therefore, the inert gas, when introduced into the tank, "inerts" the environment, preventing the formation of an explosive mixture. However, variations in temperature and pressure can affect the tank and cause damage and risks. When there is excess pressure in the tank, a valve is opened, releasing the gas phase from inside the tank to a pressure relief system that will conduct the gas along a pipeline until it is discharged through a gas vent/exhaust on the platform deck.

Unfavorable weather conditions, such as winds with low intensity (ocean wind profile in calm conditions), combined with the presence of gases with high percentage of heavy fractions (propane, butane and higher) bring some problems to the system responsible for the pressure relief of platform tanks and FPSO vessels. This pressure relief system is known as "vent post".

More specifically, for an FPSO in shallow or deep waters, winds with low intensity and gases with a high percentage of heavy fractions running through the pipeline, from the vent post to the gas outlet region (vent), are elements that hinder the proper dispersion of the gas stream coming from the platform tanks, resulting in a risk of plume return (continuous outflow of flammable gases released from the vent) towards the rig process plant.

To mitigate the risk of plume return, operations of pressure relief via the vent post system are usually restricted during adverse weather conditions, possibly resulting in a need to limit production on the platforms.

Additionally, another type of solution currently proposed is to carry out the integration of equipment (such as additional safety valves, for example) in internal sections of the vent post system, which can generate a considerable change in the deck (topside) of the platform, or even the inadequate discharge of gases into the atmosphere.

Therefore, there is an evident need in the state of the art for the development of systems capable of promoting dispersion of gases from the vent post in a safe and efficient manner, maintaining operational continuity, and capable of reducing the occurrence of alarms and production stoppages in the units due to the presence of flammable gases.

STATE OF THE ART

Investigating the background of the specified invention resulted in the discovery of documents that disclose topics related to the technological field of the current invention.

Document WO 2015/197455 describes a device for releasing unused or excess gases into ships or floating bodies, or the like, having a ventilation mast that has an outlet and is designed to guide excess, unused or similar gases to the outlet, and a feed tube that has an outlet and is designed to suck in ambient air and conduct it to the outlet. In said document, the feed tube runs to the outlet of the ventilation mast and is arranged with its outlet adjacent to the ventilation mast outlet, so that excess or unused gases, or the like, are forcibly mixed with the ambient air coming out of the feed tube, so as to fall below the lower flammability limit of the gas concentration in a mixing zone formed at the ventilation mast outlet. This document proposes a solution for gas dispersion based on the use of an additional flow of compressed air supplied from the deck of the unit directly as the dilution agent of the vent gas stream, which may not be advantageous in installations with low compressed air flow availability, or even, it may require substantial modifications to the platform design for routing high airflow pipes to the vicinity of the disposal point.

Document GB 1 387 678 refers to a method and installation for reducing the concentration of fuel gases in tanks by evacuating gas through tubes extending from the bottom of the tank into the open air, while fresh air is supplied from above. The document relates to a ventilation mast for releasing gas, inside which, to accelerate the exhaust air, additionally, a compressed air pipe is arranged at least with its outlet side section, in which the outlet of the compressed air pipe is at a considerable distance from the mast outlet and is formed so that the compressed air coming out inside the mast carries the exhaust air with it. However, the document is intended for a conventional confined space exhaust application, without the commitment to disperse the gas stream released into the external atmosphere safely in an upper region of an FPSO.

Finally, document FR 3 109 896 describes a device and method for gas treatment of a gas exhaust mast. The document refers to a gas treatment system of a gas exhaust mast of a tank containing a cold liquid from a structure such that a ship comprising at least one inlet line of a fluid, has a temperature at least higher than that of the gases at its mast outlet, up to at least one spray. The spray is located at a distance not exceeding one meter from the mast head, and is capable of spraying said fluid at an angle between 0 degrees and 90 degrees with respect to the aforementioned z'z axis, so that the fluid and gases meet, and a control circuit capable of controlling spraying of fluid by the spray when gases are evacuated by the gas exhaust mast. However, the system disclosed by the cited document employs a liquid spray on the exhaust gas, that is, it presents a working principle based on the thermal exchange between the spray (made with water at a temperature higher than the gas), with applications focused on LNG (Liquified Natural Gas).

BRIEF DESCRIPTION OF THE INVENTION

The present invention belongs to the field of technologies aimed at production units with difficulties in dispersing gases from pressure relief systems.

One of the objectives of this invention is to allow flexibility for changes to a disposal device of the vent post system and to present an appropriate technical solution, depending on the device configurations and the parameters of the expelled gases, so as to avoid gas plume return at critical concentrations to the FPSO.

Therefore, the present invention provides a gas dispersion intensifier assembly that uses one or more "blower" devices for vent post systems that will act locally to increase the airflow near the gas outlet region in a vent configuration.

Particularly, one or more blowers are positioned in the vicinity of a gas outlet region of the pipeline, in order to direct and disperse the gas flow leaving there, preventing the highly flammable gas from spreading over the vessel deck, posing a risk to equipment and people.

The blowers can be positioned in different positions and angles in the vicinity of the gas outlet of the pressure relief system.

This invention eliminates the need for the use of electrical equipment in a classified area (a region that has the possibility of an explosive atmosphere), allowing the dispersion of gases at a safe level and maintaining operational continuity, reducing the occurrence of alarms and production stoppages in the units due to the presence of flammable gases.

Therefore, the advantages and objectives of the present invention are achieved by providing a gas dispersion intensifier assembly for a pressure relief system, which comprises: at least one blower; and a gas dispersion pipe with a gas outlet nozzle; wherein at least one blower is arranged externally and in the vicinity of the gas outlet nozzle, and projects an air flow toward the gas flow expelled by the gas outlet nozzle.

BRIEF DESCRIPTION OF THE FIGURES

The previous brief description, as well as the breakdown of the preferred embodiments of the invention under discussion, presented below, will be better understood when read in conjunction with the attached drawings. For the purpose of illustrating the present invention, embodiments thereof are shown in the drawings. However, it must be understood that the invention under discussion is not limited only to the precise arrangements and instruments shown.

The patent or application file contains at least one drawing executed in color. Copies of this patent or patent application publication with color drawing(s) will be provided by the Office upon request and payment of the necessary fee.

Figure 1:
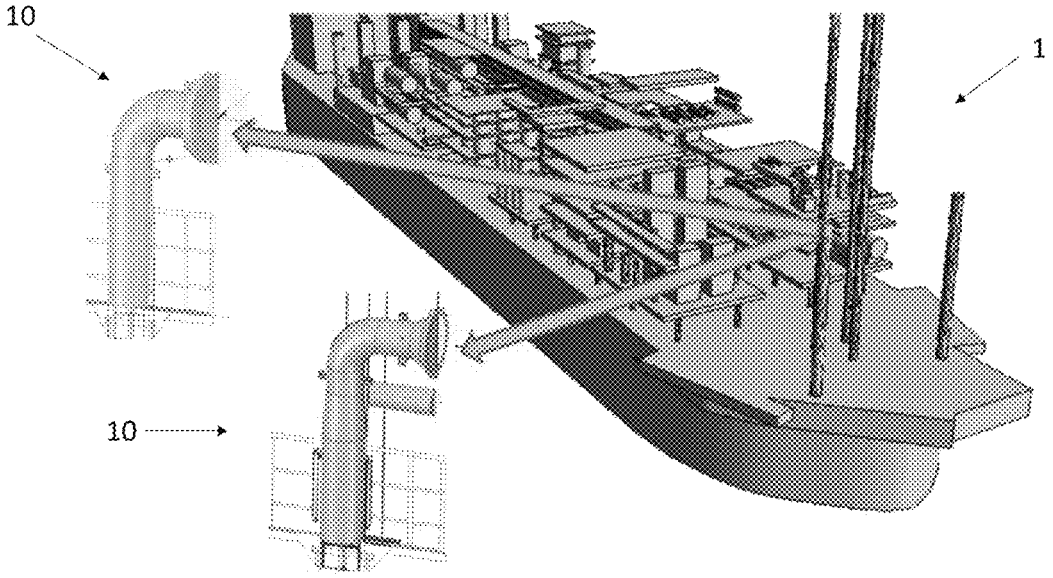

Thus, the present invention will be described below with reference to the typical embodiments thereof and also with reference to the attached drawings, wherein:

FIG. 1 shows an FPSO with the indication of the location of the gas outlet pipes of a pressure relief system, according to an exemplifying configuration of the present invention.

Figure 2A:
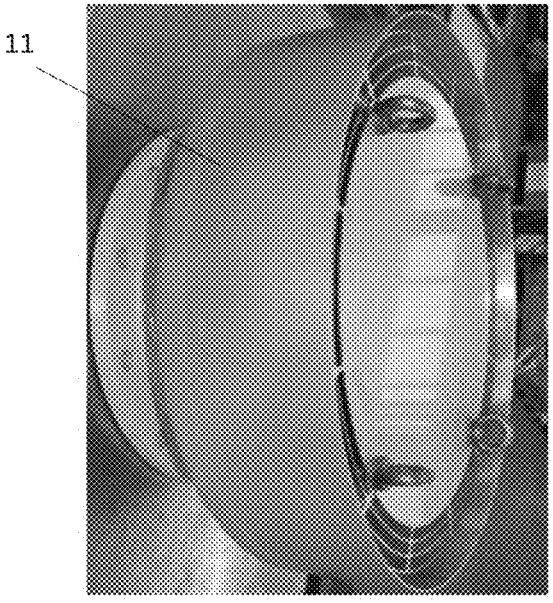

FIG. 2A shows a photograph of the gas outlet nozzle of the gas outlet pipe, according to an illustrative configuration of this invention.

Figure 2B:
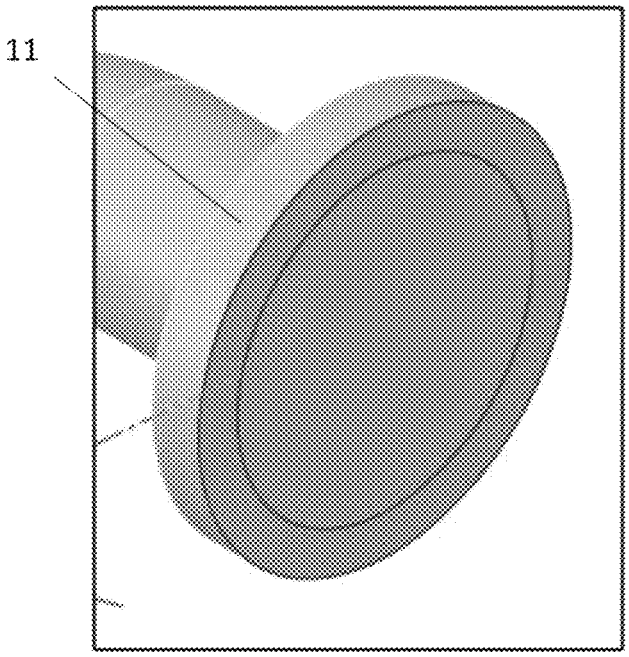

FIG. 2B shows a model of a gas outlet nozzle of the gas outlet pipe, according to an illustrative configuration of this invention.

Figure 3A:
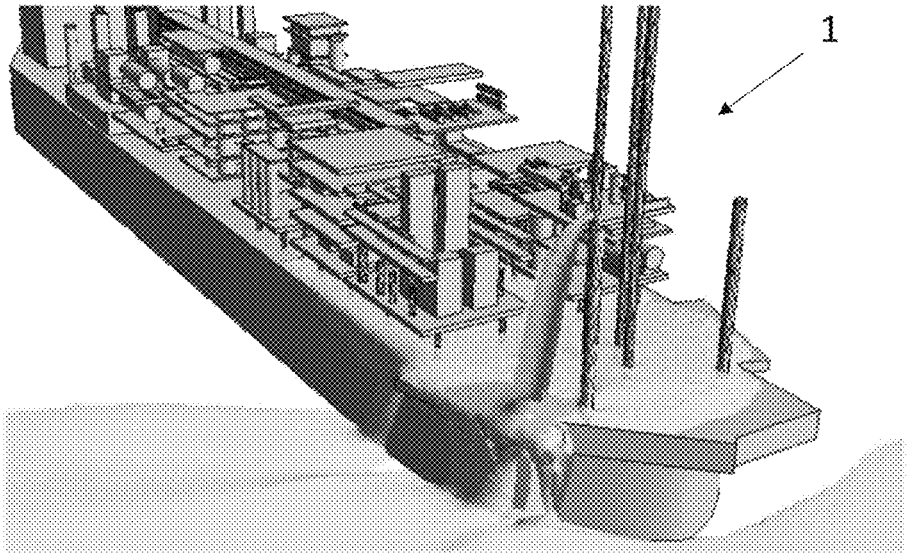

FIG. 3A presents an overview of plumes of 20% and 60% of the LII for critical scenarios in an FPSO without using a gas dispersion intensifying assembly and headwind (south direction) with an intensity of 0.1 m/s, according to an exemplary configuration of the present invention.

Figure 3B:
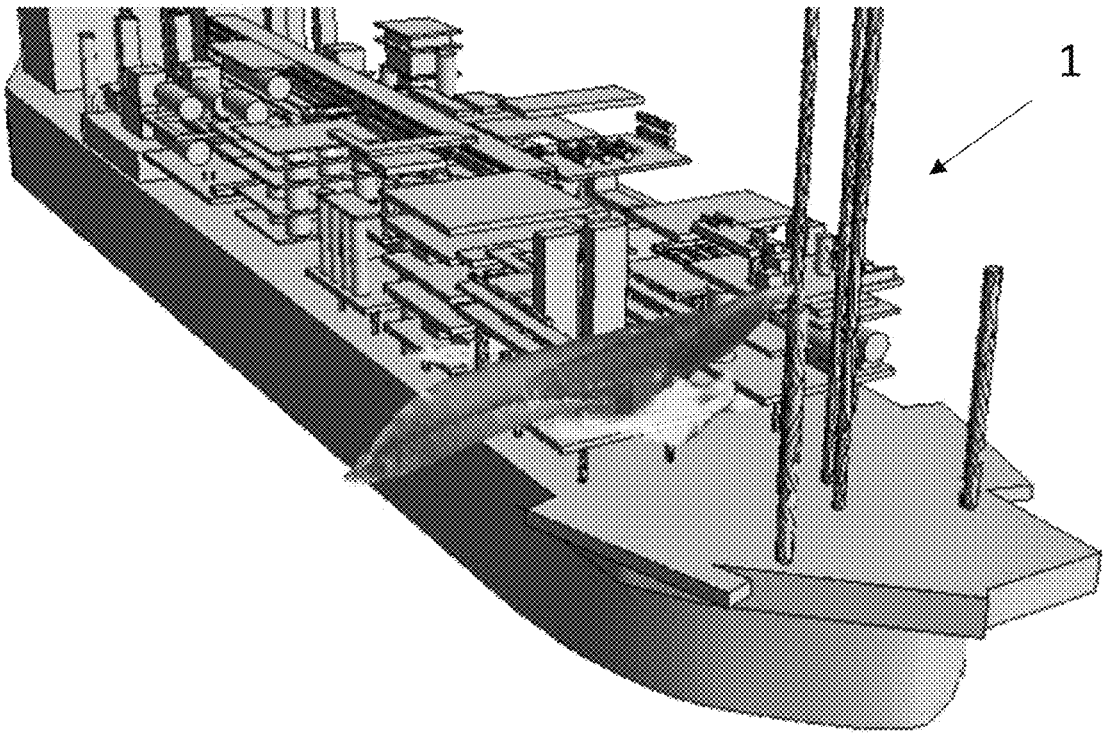

FIG. 3B presents an overview of plumes of 20% and 60% of the LII for critical scenarios in an FPSO without using a gas dispersion intensifying assembly and headwind (south direction) with an intensity of 0.5 m/s, according to an exemplary configuration of the present invention.

Figure 4:
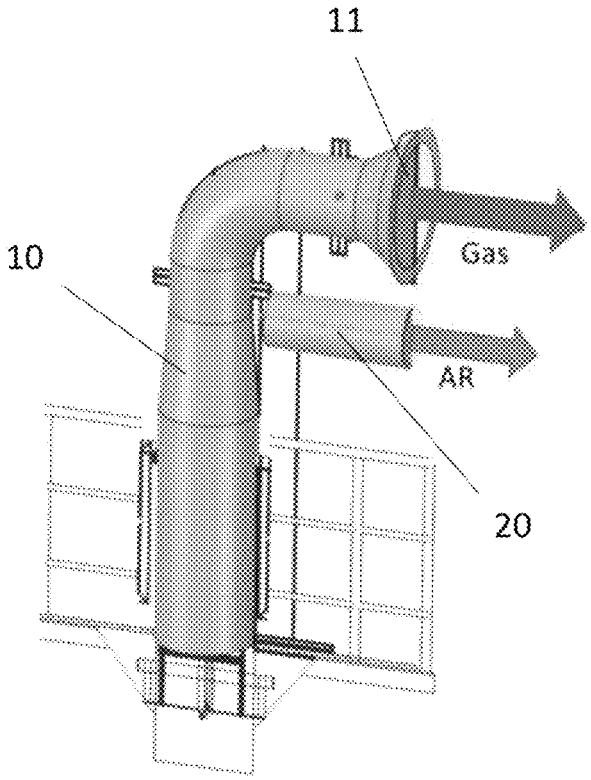

FIG. 4 presents a blower installed in the vicinity of a gas outlet nozzle, according to a first configuration that exemplifies the present invention.

Figure 5:
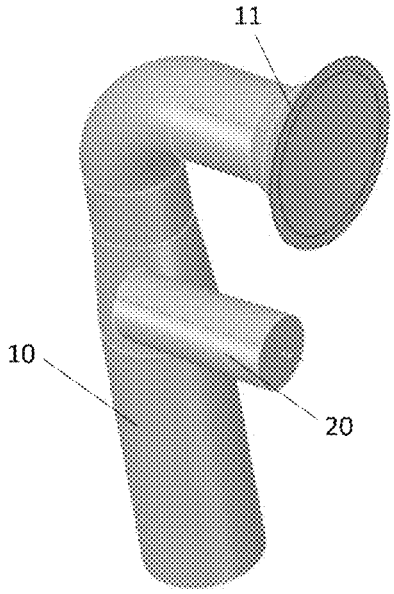

FIG. 5 presents a blower installed in the vicinity of a gas outlet nozzle, according to a second configuration that exemplifies the present invention.

Figure 6:
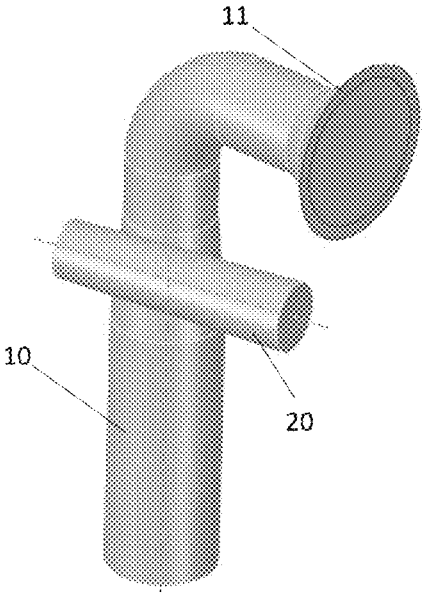

FIG. 6 presents a blower installed in the vicinity of a gas outlet nozzle, according to a third configuration that exemplifies the present invention.

Figure 7:
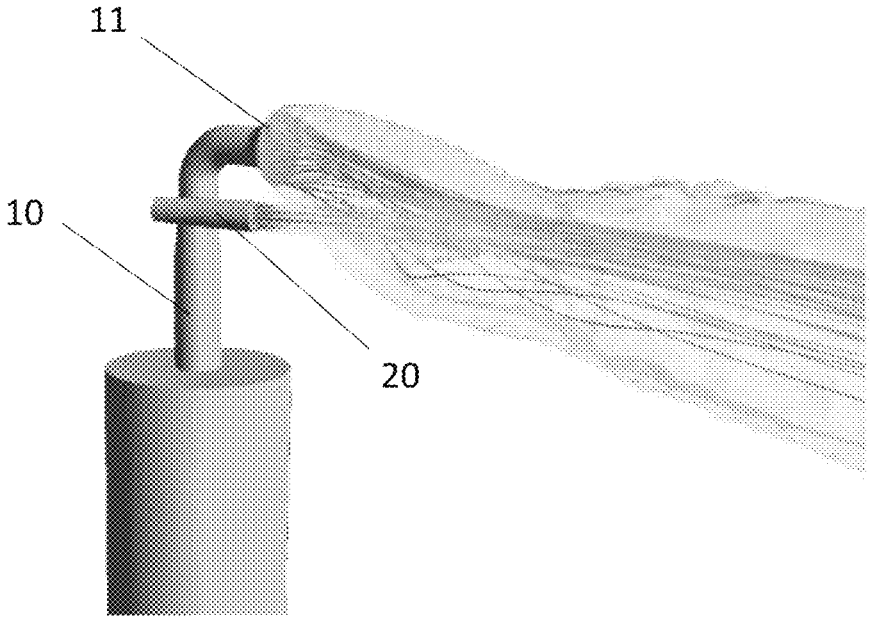

FIG. 7 shows the use of a blower installed in the vicinity of a gas outlet nozzle, according to the third configuration that exemplifies the present invention.

Figure 8:
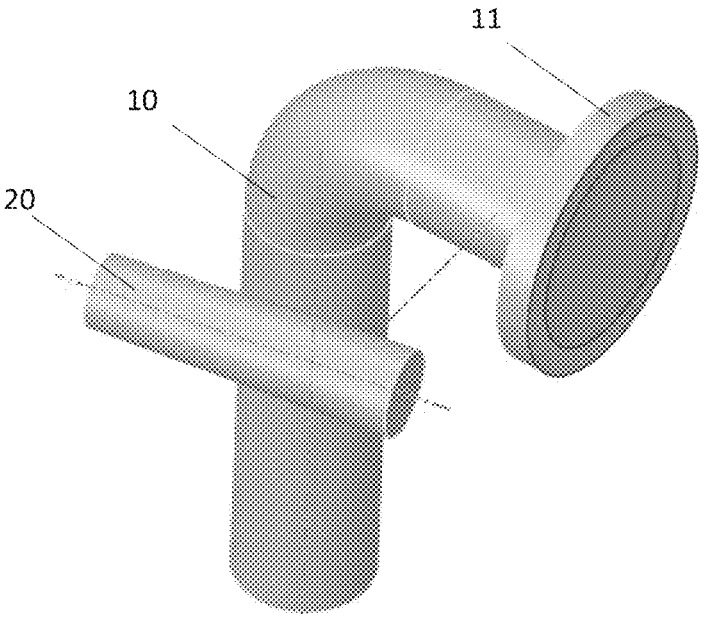

FIG. 8 presents a blower installed in the vicinity of a gas outlet nozzle, according to a fourth configuration that exemplifies the present invention.

Figure 9:
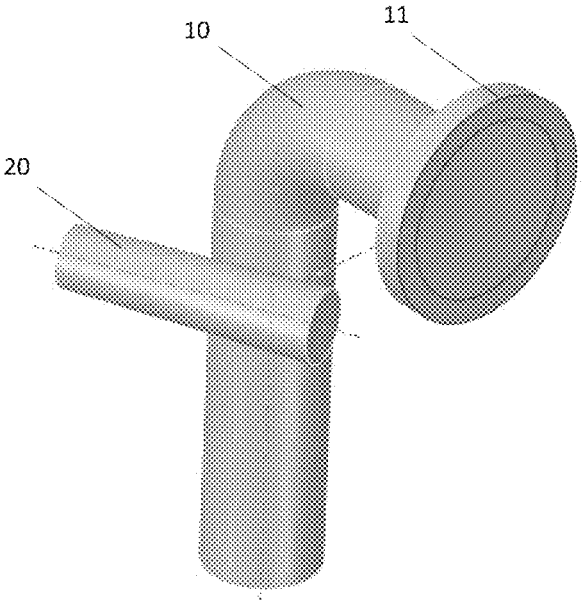

FIG. 9 presents a blower installed in the vicinity of a gas outlet nozzle, according to a fourth configuration that exemplifies the present invention.

Figure 10:
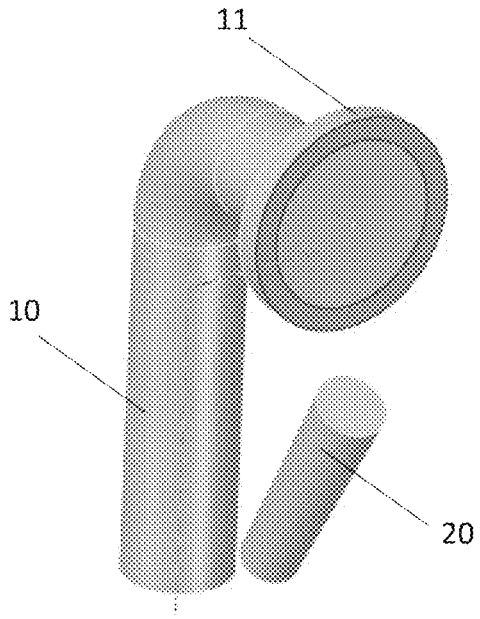

FIG. 10 presents a blower installed in the vicinity of a gas outlet nozzle, according to a sixth configuration that exemplifies the present invention.

Figure 11:
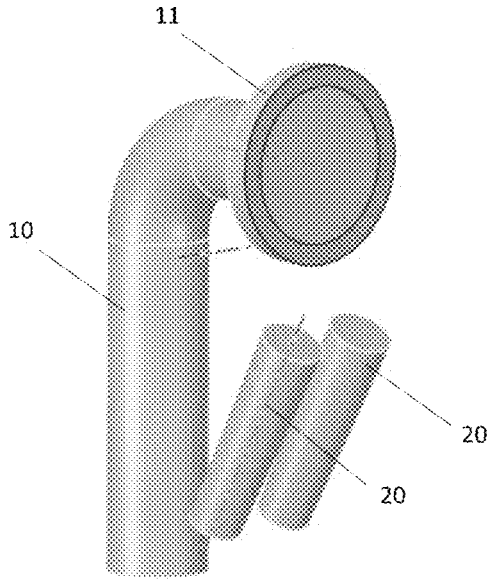

FIG. 11 presents two blowers installed in the vicinity of a gas outlet nozzle, according to a seventh configuration that exemplifies the present invention.

Figure 12:
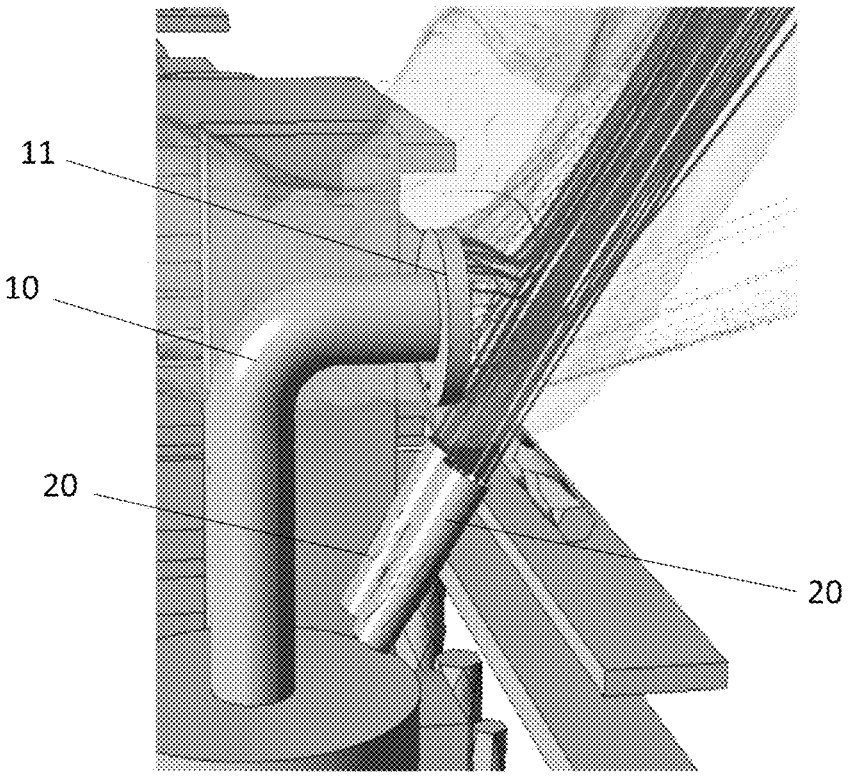

FIG. 12 shows the use of two blowers installed in the vicinity of a gas outlet nozzle, according to the seventh configuration of this invention.

Figure 13:
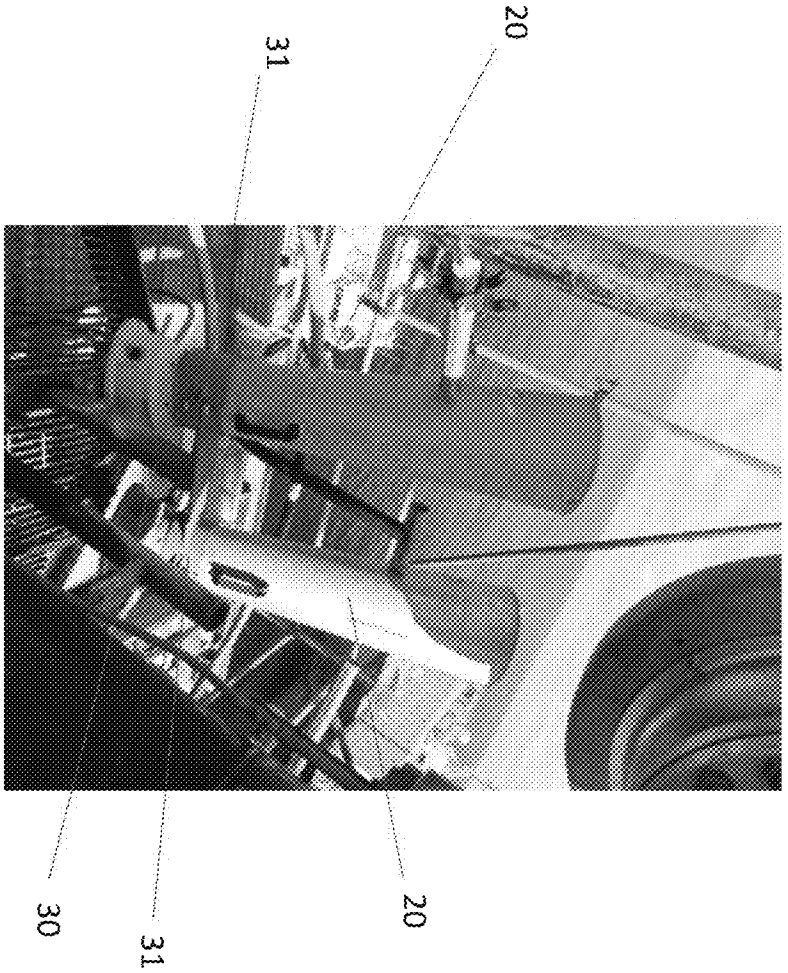

FIG. 13 shows two blowers installed on a supporting structure, according to a configuration that exemplifies the present invention.

Figure 14:
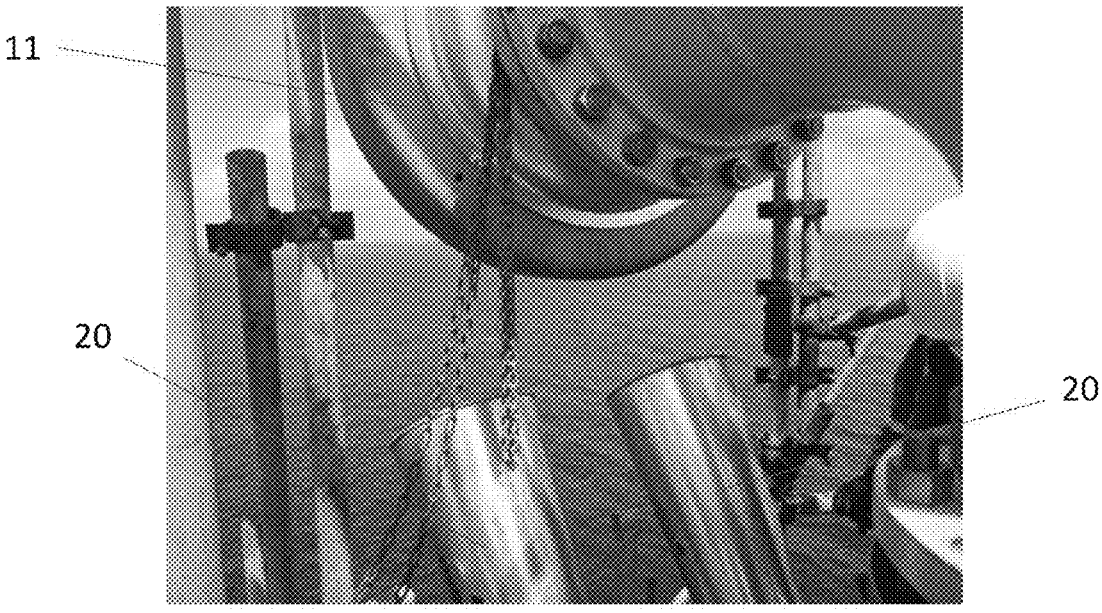

FIG. 14 presents two blowers installed in the vicinity of a gas outlet nozzle, according to a configuration that exemplifies the present invention.

Figure 15:
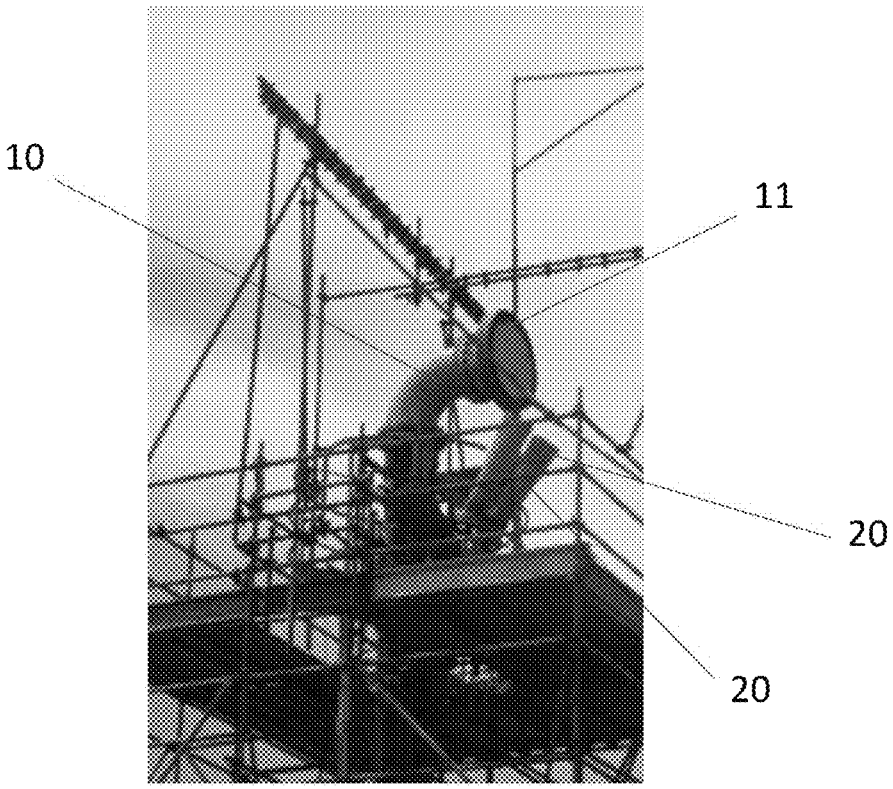

FIG. 15 also presents two blowers installed in the vicinity of a gas outlet nozzle, according to a configuration that exemplifies the present invention.

DETAILED DESCRIPTION OF THE INVENTION

Reference is made in detail below to the preferred modalities of the present invention illustrated in the attached drawings. Whenever possible, the same or similar reference numbers will be used throughout the drawings to refer to the same or similar characteristics. It should be noted that the drawings are in simplified form and are not drawn at precise scale, so slight variations may occur.

Before describing in detail the characteristics of the gas dispersion intensifier assembly of this invention, it is necessary to elucidate the concept of lower flammability limit (LII). The LII refers to the range of minimum concentration, in the air, of vapors of a substance that can lead to a flammable condition.

The different configurations, techniques and methodologies that will be described below refer to a gas dispersion intensifier assembly for an FPSO pressure relief system, which provides one or more blowers installed in the vicinity of a gas dispersion nozzle of a vent post system, and the one or more blowers have specific mounting configurations, capable of varying in height and degree, to intensify the dispersion of the expelled gases by the gas dispersion nozzle in the pipeline discharge region, ensuring a mixture between the flow of the expelled gases and the air flow generated by one or more blowers.

To implement at least one air blower in the vicinity of the pipeline gas discharge region, the present invention also takes into account wind intensity and direction in the unit.

Thus, the present invention is ideal to be used in situations where the average speed of gases out of the gas outlet nozzle (vent post termination) is low, which also hinders the dispersion of gases in low wind conditions.

Reference is made to FIG. 1, which presents, as an example, the geometry of an upper portion ("topside") of an FPSO 1, and the arrangement of gas outlet pipes 10, where the gas dispersion intensifier assembly will be used according to an embodiment of this invention.

FIGS. 2A and 2B exemplify the surface of the gas outlet nozzle 11 of a vent post system. It is worth noting that the larger the diameter of the gas outlet nozzle 11 of the vent post, for the same gas flow, the lower the average velocity of gas outlet from the nozzle, promoting greater difficulties in gas dispersion in calm conditions.

FIGS. 3A and 3B present a representation of a critical scenario for an FPSO 1 under the action of low intensity winds, wherein the pressure relief system does not have a gas dispersion intensifier assembly, so that gas plumes with concentrations equivalent to 20% of the LII (in yellow) and 60% of the LII (in orange) are dumped directly on the deck of the FPSO 1. Specifically, FIG. 3A shows a calm condition (wind intensity close to 0.1 m/s) and FIG. 3B shows a low wind condition (wind intensity around 0.5 m/s).

In a first embodiment of the present invention, as shown in FIG. 4, the gas dispersion intensifier assembly for the pressure relief system comprises a blower 20 and a pipe 10 with gas outlet nozzle 11, in which the blower 20 is arranged externally and in the vicinity of a gas outlet nozzle 11, preferably the blower 20 is arranged below and parallel to the nozzle 11, with the air flow expelled by the blower 20 being parallel to the gas flow expelled by the gas outlet nozzle 11. This embodiment is applied in the event that the gas released by the gas outlet nozzle 11 tends to fall on the air flow and be propelled away from the rig and diluted by it.

In a second embodiment of the present invention, as shown in FIG. 5, the gas dispersion intensifier assembly for the pressure relief system comprises a blower 20 and a pipe 10 with gas outlet nozzle 11, in which the blower 20 is arranged externally and in the vicinity of a gas outlet nozzle 11, preferably the blower 20 is arranged below and parallel to the nozzle 11, being further positioned on one side of the gas dispersion pipe 10 containing the gas outlet nozzle 11. In this configuration, the blower 20 can protect the modules near the pipe 10, in the event that the plume is carried by the wind in a certain direction.

In a third embodiment of the present invention, as shown in FIG. 6, the gas dispersion intensifier assembly for pressure relief system comprises a blower 20 and a pipe 10 with gas outlet nozzle 11, in which the blower 20 is arranged externally and in the vicinity of a gas outlet nozzle 11, and preferably, the blower 20 is placed below the nozzle 11, and is also positioned on one side of the pipe 10 containing the gas outlet nozzle 11. Moreover, the blower 20 is configured to rotate around its longitudinal axis between 0° and about 10°, preferably about 10°, in the gas discharge direction. In this configuration, the effectiveness of the air jet form the blower 20 inclined in the direction of the gas jets is evidenced, as shown in FIG. 7.

In a fourth embodiment of the present invention, as shown in FIG. 8, the gas dispersion intensifier assembly for pressure relief system comprises a blower 20 and a pipe 10 with gas outlet nozzle 11, in which the blower 20 is arranged externally and in the vicinity of a gas outlet nozzle 11, and preferably, the blower 20 is placed below the nozzle 11, and is also recessed and positioned on one side of the gas dispersion pipe 10 containing the gas outlet nozzle 11. Moreover, the blower 20 is configured to rotate around its longitudinal axis between 0° and about 10°, preferably about 10°, in the gas discharge direction.

In a fifth embodiment of the present invention, as shown in FIG. 9, the gas dispersion intensifier assembly for pressure relief system comprises a blower 20 and a pipe 10 with gas outlet nozzle 11, in which the blower 20 is arranged externally and in the vicinity of a gas outlet nozzle 11, and preferably, the blower 20 is placed below the gas outlet nozzle 11, and is also recessed and positioned on one side of the pipe 10 containing the gas outlet nozzle 11. Moreover, the blower 20 is configured to rotate around its longitudinal axis between 0° and about 20°, preferably about 20°, in the gas discharge direction.

In a sixth embodiment of the present invention, as shown in FIG. 10, the gas dispersion intensifier assembly for the pressure relief system comprises a blower 20 and a duct 10 with a gas outlet nozzle 11, in which the blower 20 is arranged externally and in the vicinity of a gas outlet nozzle 11, and preferably, the blower 20 is arranged below the gas outlet nozzle 11, with the longitudinal axis of the blower 20 inclined between 0° and about 30°, preferably about 30°, relative to the vertical in the gas discharge direction. In this configuration, the airflow expelled by the blower 20 is directed from the bottom to the top, meeting the gas flow expelled by the gas outlet nozzle 11 and out of the FPSO. In addition, this position of the blower 20 in the assembly favors the adequate dispersion of the plume, which tends to perform a downward movement when it is expelled through the nozzle 11 of the pipe 10, especially in cases of low gas flow.

In a seventh embodiment of the present invention, as shown in FIG. 11, the gas dispersion intensifier assembly for pressure relief system comprises two blowers 20 and a pipe 10 with a gas outlet nozzle 11, in which each blower 20 is arranged below the gas outlet nozzle 11, with the longitudinal axis inclined between 0° and about 30°, preferably about 30°, in relation to the vertical in the gas discharge direction. The blowers 20 can be parallel, or divergent, to each other. FIG. 12 shows the two blowers in use, according to this configuration, projecting the airflow towards the gas flow to promote their dispersion.

It should be noted that, although the embodiments described above have one or two blowers 20, the present invention can be adapted to work with three or more blowers 20, depending on the design conditions and implementation, so that the objective of dispersing gases in a more efficient and safe manner is achieved.

In addition, the blowers 20 of the intensifier assembly of the present invention are connected to a compressed air supply source, and supplied by it with a compressed air flow rate between approximately 211 $m^3/h$ and approximately 844 $m^3/h$, with the compressed air pressure ranging from approximately 300 kPa (3 bar) to approximately 550 kPa (5.5 bar). The blowers 20 being configured to operate with an air flow rate at the output of the blower 20 between about 4,055 $m^3/h$ and about 5,970 $m^3/h$. It is important to highlight that the blower of the present invention provides high air flow at the outlet of the diffuser end, since the blower uses the compressed air supply flow as the driving fluid to generate Venturi effect locally and suck ambient air close to the airflow disposal point.

The air blower, according to an embodiment of the present invention, has a frustoconical shape, with the diameter of the base of the blower being smaller than the diameter of the diffuser end that expels the airflow.

Also, as shown as an example in FIG. 13, the dispersion intensifier assembly also comprises a supporting structure 30 including clamping sections 31 to removably couple one or more blowers 20.

FIGS. 14 and 15 show, for example, the positioning of the two blowers 20 in the vicinity of a gas outlet nozzle 11, according to an embodiment of the present invention.

The present invention further provides that each blower 20 may be moved or tilted, in any direction, to direct the airflow in the direction of the gas flow coming from the gas outlet nozzle 11 in order to intensify the dispersion of the gases, depending on the intensity and direction of the winds and the flow rate of expelled gas.

Therefore, one person skilled in the art will understand that each blower 20 described above of the dispersion intensifier assembly of the present invention may be positioned at any location in the vicinity of the gas outlet nozzle 11 of the vent post system and tilted in any direction, without departing from the purpose of the present invention to intensify the dispersion of the expelled gases and maintain the safety and productivity of the operation in an FPSO.

The skilled in the art will value the knowledge presented herein and can reproduce the invention in the presented embodiments and their variants, which are covered in the scope of the claims below.

What is claimed is:

1. A gas dispersion intensifier assembly for a pressure relief system, the assembly comprising:
- a blower; and
- a gas dispersion pipe with a gas outlet nozzle;
- wherein the blower is arranged externally and in the vicinity of the gas outlet nozzle, and wherein the blower projects an air flow towards a gas flow expelled by the gas outlet nozzle, and
- wherein the blower is configured to rotate about a longitudinal axis up to 20° in a direction of gas discharge.

2. The assembly of claim 1, wherein the blower is arranged below or on sides of the gas outlet nozzle.

3. The assembly of claim 1, wherein the blower is disposed at a side of the gas dispersion pipe.

4. The assembly of claim 1, wherein the blower is arranged below the gas outlet nozzle, and
- wherein a longitudinal axis of the blower is inclined up to 30° with respect to a vertical axis in a direction of gas discharge.

5. The assembly of claim 1, wherein the assembly comprises a second blower.

6. The assembly of claim 1, wherein the blower operates with an air flow rate at an outlet of the blower between 4,055 $m^3/h$ and 5,970 $m^3/h$.

7. The assembly of claim 1, wherein the blower has a frustoconical shape, and
- wherein a diameter of a blower base is smaller than a diameter of a diffuser end that expels an airflow.

8. The assembly of claim 1, further comprising a supporting structure including clamping sections to removably couple the blower.

9. A gas dispersion intensifier assembly for a pressure relief system, the assembly comprising:
- a blower; and
- a gas dispersion pipe with a gas outlet nozzle;
- wherein the blower is arranged externally and in the vicinity of the gas outlet nozzle, and wherein the blower projects an air flow towards a gas flow expelled by the gas outlet nozzle,
- wherein the blower is arranged below the gas outlet nozzle, and
- wherein a longitudinal axis of the blower is inclined up to 30° with respect to a vertical axis in a direction of gas discharge.

10. The assembly of claim 9, wherein the blower is arranged below or on sides of the gas outlet nozzle.

11. The assembly of claim 9, wherein the blower is-disposed at a side of the gas dispersion pipe.

12. The assembly of claim 10, wherein the blower is configured to rotate about a longitudinal axis up to 20° in a direction of gas discharge.

13. A gas dispersion intensifier assembly for a pressure relief system, the assembly comprising:
- a blower; and
- a gas dispersion pipe with a gas outlet nozzle;
- wherein the blower is arranged externally and in the vicinity of the gas outlet nozzle, and wherein the blower projects an air flow towards a gas flow expelled by the gas outlet nozzle,
- wherein the blower operates with an air flow rate at an outlet of the blower between 4,055 $m^3/h$ and 5,970 $m^3/h$.

14. The assembly of claim 13, wherein the blower is arranged below or on sides of the gas outlet nozzle.

15. The assembly of claim 13, wherein the blower is-disposed at a side of the gas dispersion pipe.

16. The assembly of claim 14, wherein the blower is configured to rotate about a longitudinal axis up to 20° in a direction of gas discharge.

17. A gas dispersion intensifier assembly for a pressure relief system, the assembly comprising:
- a blower; and
- a gas dispersion pipe with a gas outlet nozzle;
- wherein the blower is arranged externally and in the vicinity of the gas outlet nozzle, and wherein the blower projects an air flow towards a gas flow expelled by the gas outlet nozzle,
- wherein the blower has a frustoconical shape, and
- wherein a diameter of a blower base is smaller than a diameter of a diffuser end that expels an airflow.

18. The assembly of claim 17, wherein the blower is arranged below or on sides of the gas outlet nozzle.

19. The assembly of claim 17, wherein the blower is disposed at a side of the gas dispersion pipe.

20. The assembly of claim 17, wherein the blower is configured to rotate about a longitudinal axis up to 20° in a direction of gas discharge.

21. A gas dispersion intensifier assembly for a pressure relief system, the assembly comprising:
- a blower;
- a gas dispersion pipe with a gas outlet nozzle; and
- a supporting structure including clamping sections to removably couple the blower,
- wherein the blower is arranged externally and in the vicinity of the gas outlet nozzle, and wherein the blower projects an air flow towards a gas flow expelled by the gas outlet nozzle.

22. The assembly of claim 21, wherein the blower is arranged below or on sides of the gas outlet nozzle.

23. The assembly of claim 21, wherein the blower is-disposed at a side of the gas dispersion pipe.

24. The assembly of claim 21, wherein the blower is configured to rotate about a longitudinal axis up to 20° in a direction of gas discharge.

* * * * *